US007520026B1

(12) United States Patent
Lin

(10) Patent No.: US 7,520,026 B1
(45) Date of Patent: Apr. 21, 2009

(54) HINGE ASSEMBLY

(75) Inventor: Chao-Chi Lin, Taichung (TW)

(73) Assignee: Leohab Enterprise Co., Ltd., Taichung (TW)

( * ) Notice: Subject to any disclaimer, the term of this patent is extended or adjusted under 35 U.S.C. 154(b) by 0 days.

(21) Appl. No.: 12/047,365

(22) Filed: Mar. 13, 2008

(30) Foreign Application Priority Data

Feb. 5, 2008 (TW) ..... 97104747 A

(51) Int. Cl.
*E05C 17/64* (2006.01)

(52) U.S. Cl. ..... 16/337; 16/340

(58) Field of Classification Search ..... 16/330, 16/303, 337–342, 374; 361/680–682; 248/919, 248/923
See application file for complete search history.

(56) References Cited

U.S. PATENT DOCUMENTS 6,665,907 B1 * 12/2003 Lu ..... 16/340
6,757,940 B2 * 7/2004 Lu et al. ..... 16/330
6,813,813 B2 * 11/2004 Lu et al. ..... 16/342
6,862,779 B1 * 3/2005 Lu et al. ..... 16/340
7,082,643 B2 * 8/2006 Lu et al. ..... 16/340
7,114,218 B1 * 10/2006 Lin ..... 16/342
7,222,396 B2 * 5/2007 Lu et al. ..... 16/340
7,478,458 B2 * 1/2009 Tajima ..... 16/367
2007/0136992 A1 * 6/2007 Lu et al. ..... 16/330
2008/0271293 A1 * 11/2008 Hsu et al. ..... 16/367

FOREIGN PATENT DOCUMENTS

CN ZL200520127486.1 11/2006

* cited by examiner

*Primary Examiner*—William L. Miller
(74) *Attorney, Agent, or Firm*—Alan Kamrath; Kamrath & Associates PA

(57) ABSTRACT

A hinge assembly includes a pintle supporting a first coupling member and a second coupling member. The second coupling member includes two protrusions formed on two opposing faces. Two position limiting members simultaneously abut against the protrusions respectively when the hinge assembly is fully opened. A biasing means include a plurality of resilient members that provides non-continuous contact with the pintle.

11 Claims, 15 Drawing Sheets

HINGE ASSEMBLY

BACKGROUND OF THE INVENTION

1. Field of the Invention

The present invention relates to a hinge assembly.

2. Description of the Related Art

It is known that a hinge assembly of a notebook computer enables a movement of a display and a base connected thereto relatively, provides torque in order to maintain the display at a particular position and some even designed to facilitate user opening the notebook as well as prevents slam when closing the notebook. As an example, Chinese Patent ZL 200520127486.1 discloses a hinge assembly with the feature of facilitating user opening the notebook as well as preventing slam when closing the notebook. However, a problem with such a hinge assembly is that engagement of a position limiting member 30 with a protrusion 221 extended from a second coupling member 20 when the hinge assembly is fully opened is not reliable. In this case, it is not recommended to put more accessories, such as a web cam, or a mini loudspeaker, or an antenna, and other items on a display of a notebook computer.

The present invention is, therefore, intended to obviate or at least alleviate the problems encountered in the prior art.

SUMMARY OF THE INVENTION

It is therefore an object of the present invention to provide a hinge assembly that overcomes the hereinbefore mentioned problems.

Accordingly, the object is achieved by providing a hinge assembly that includes a pintle having a first section and a second section. The first section can support a first coupling member. The second section can support a second coupling member, a first and a second position limiting member, and a biasing device.

The second coupling member includes two opposing faces, a first protrusion on one face, and a second protrusion on another face respectively.

The first limiting member includes an engaging portion the first protrusion can selectively abut, and the second position limiting member includes an engaging portion the second protrusion can selectively abut.

The biasing means includes a plurality of resilient members. Each resilient member includes a hole having a wall portion that provides non-continuous contact with the second section of the pintle.

In one embodiment, each resilient member includes a hole having two arcuate wall portions and two undulating wall sections for non-continuous contact with the second section of the pintle.

In another embodiment, each resilient member includes a hole having two arcuate wall portions and two undulating wall sections. Each arcuate wall portion has two notches extending radially outward from the hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DETAILED DESCRIPTION OF THE PREFERRED EMBODIMENT

Figure 1:
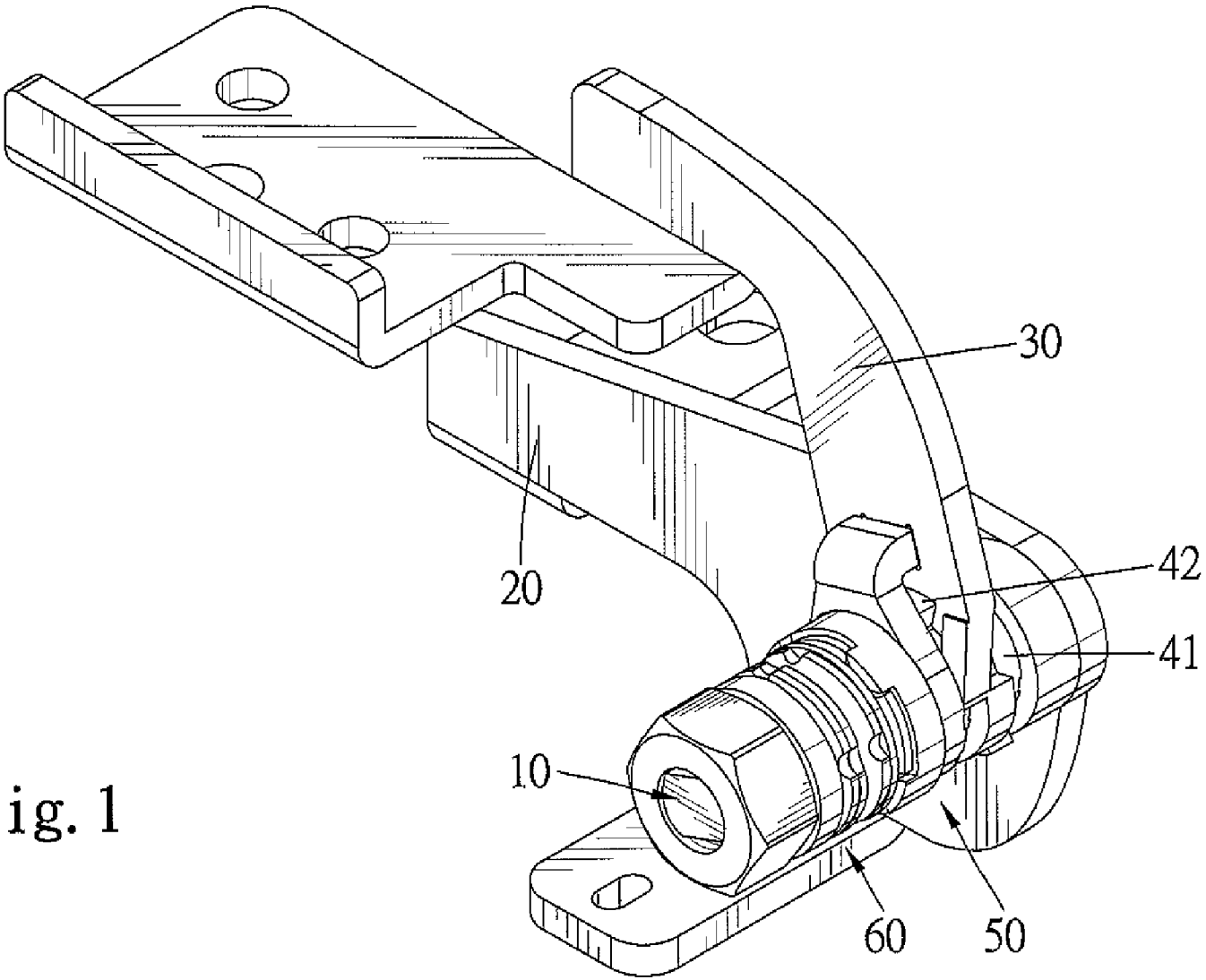
FIG. 1 is a perspective view of a hinge assembly embodying the present invention.

Referring to FIGS. 1 through 4, a hinge assembly embodying the present invention includes a pintle 10 defining a first section 11, a second section 12 and a shoulder 13 therebetween. A first coupling member 20 is supported on the first section 11 and is configured to couple to a base of a notebook computer. The first coupling member 20 includes a hole 21 with a cross section of non-circular shape and in which the first section 11 of the pintle 10 can be complemently fitted in a manner that precludes relative movement therebetween. A second coupling member 30, a first and a second position limiting member 41,42, a positioning means 50, and a biasing means 60 are supported on the second section 12. The second section 12 has a cross section of non-circular shape. In this preferred opposing arcuate surfaces interconnecting the flat surfaces. Additionally, the arcuate surfaces has threaded portions 121 partially and correspondingly formed thereon, respectively, for engaging an end cap 14. The end cap 14 is provided to preclude disengagement of the second coupling member 30, the first and second position limiting members 41,42, the positioning means 50, and the biasing means 60 from the second portion 12.

Figure 5:
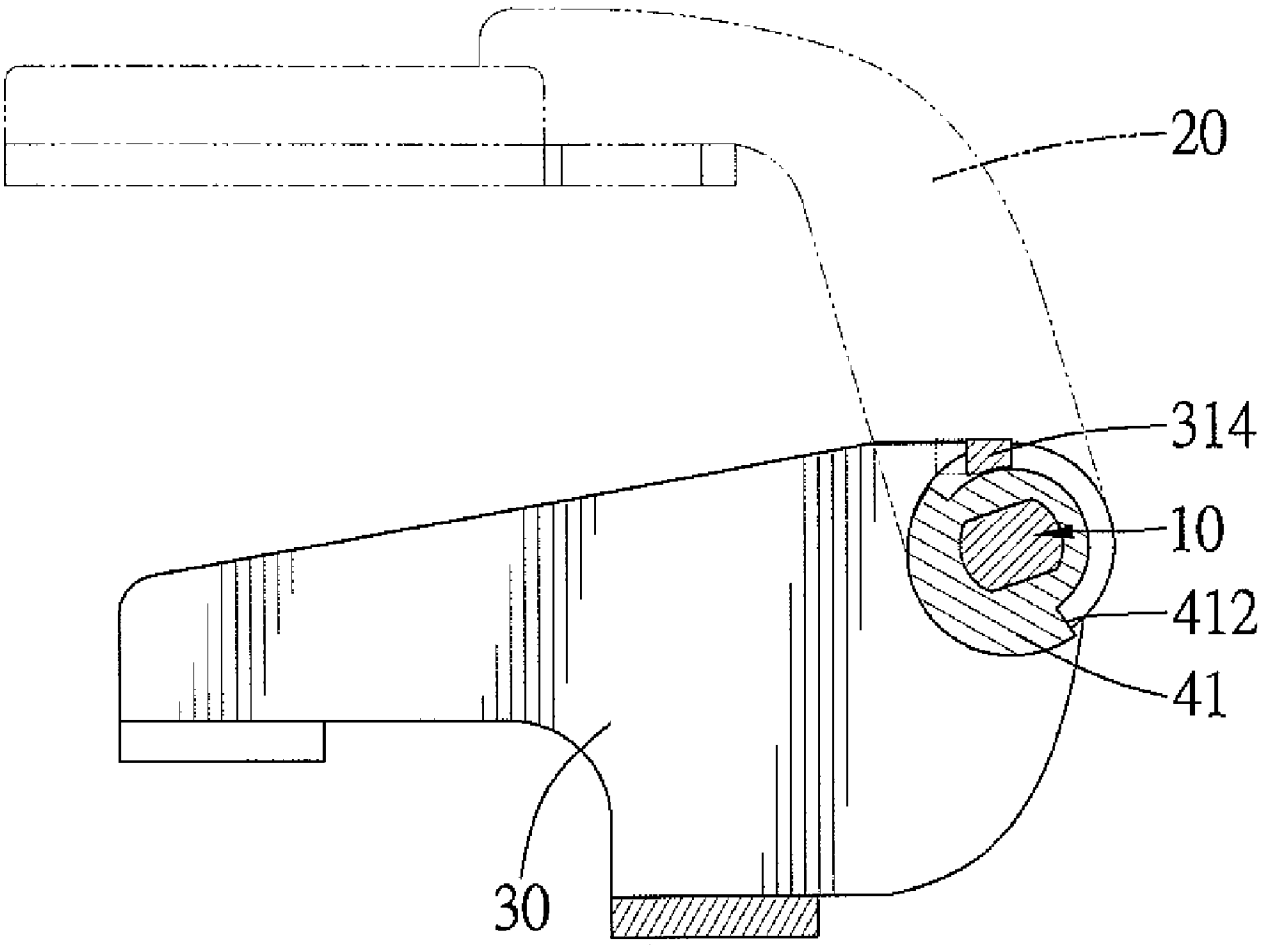
FIG. 5 is a cross-sectional view taken along line 5-5 of FIG. 4.
Figure 5A:
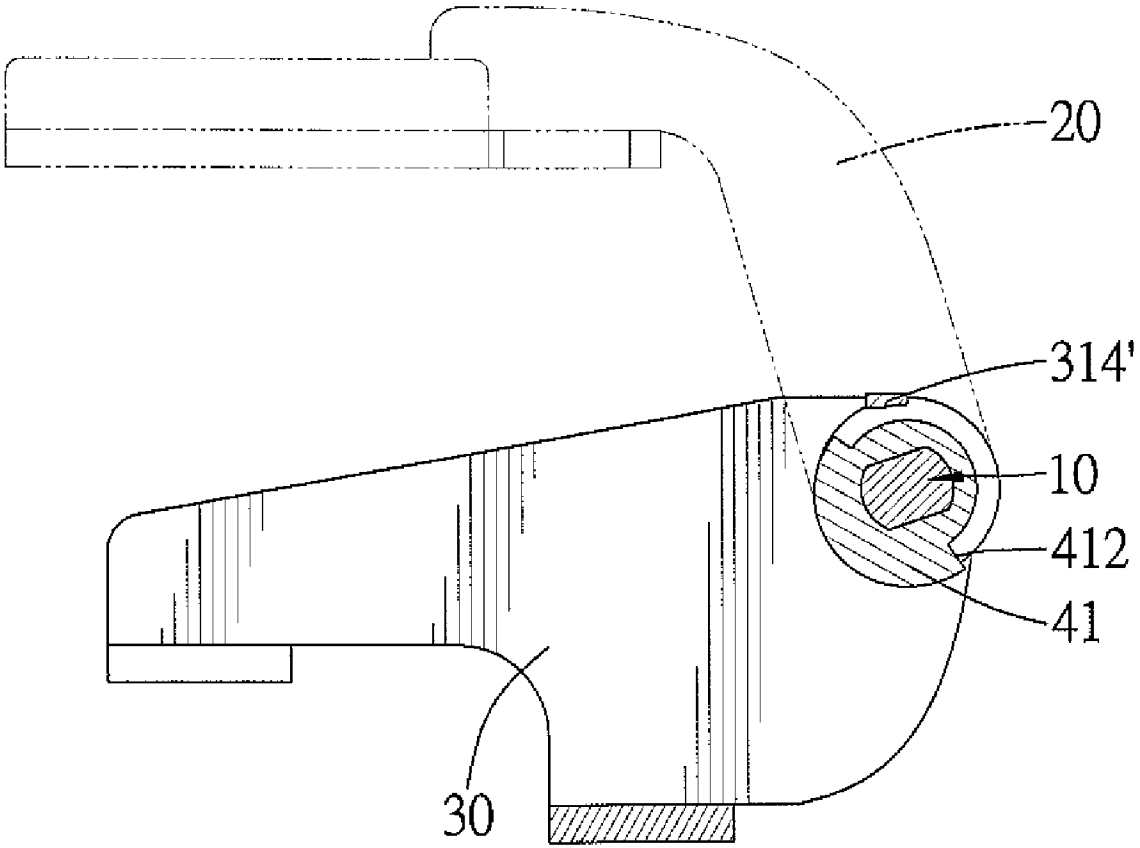
FIGS. 5A and 5B show alternate first and second protrusions of the hinge assembly respectively.
Figure 5B:
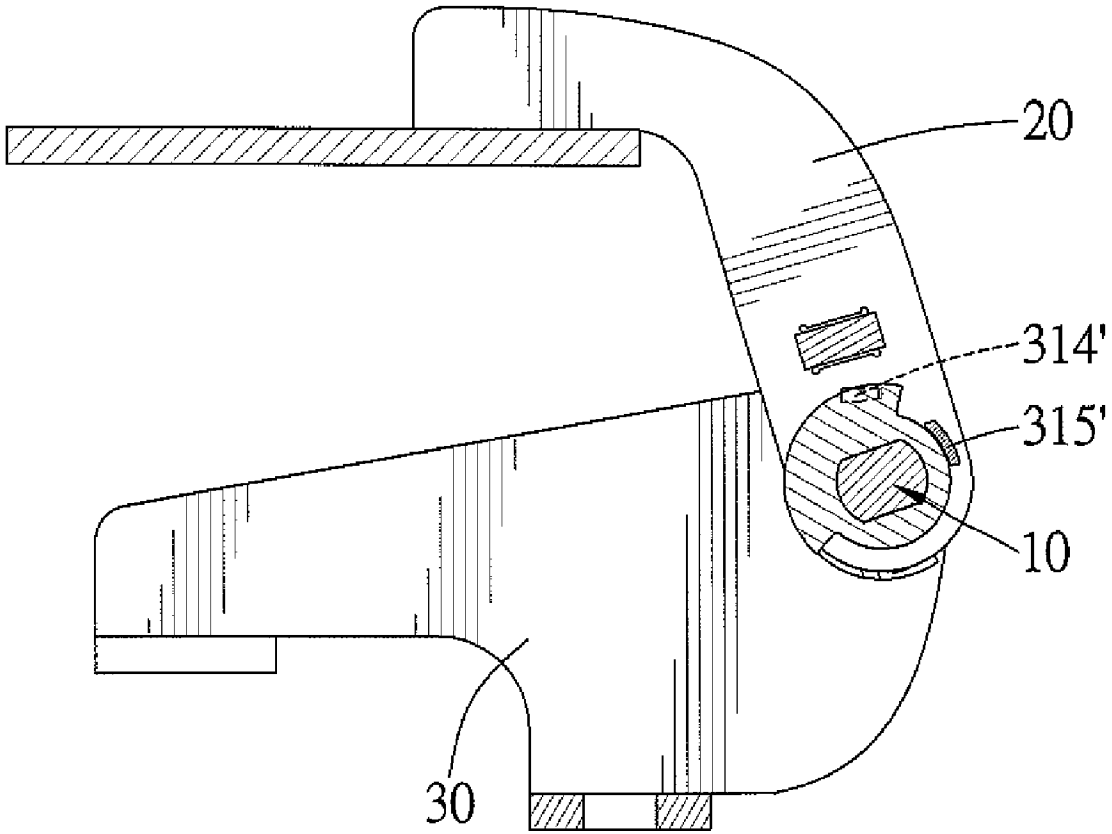
Figure 6:
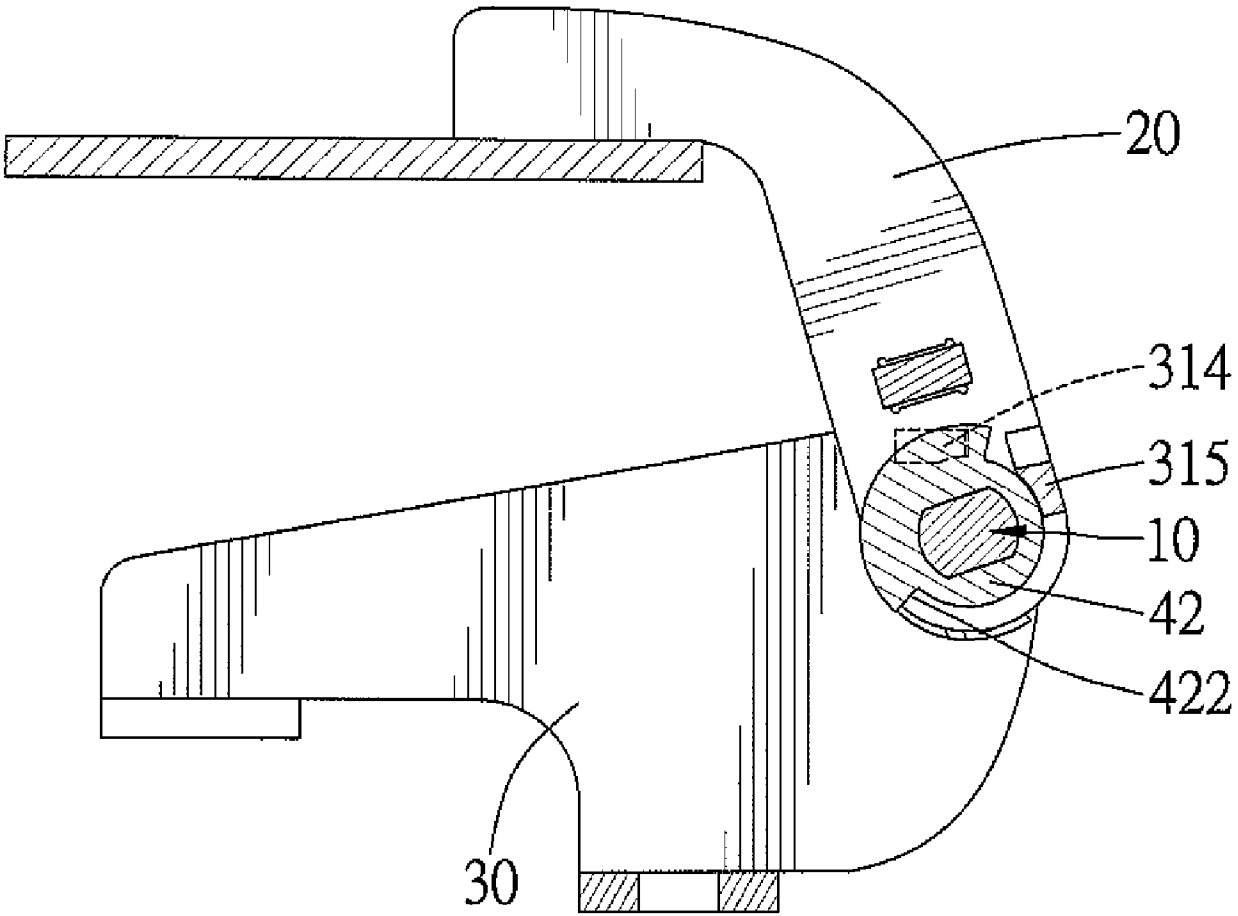
FIG. 6 is a cross-sectional view taken along line 6-6 of FIG. 4.
Figure 6A:
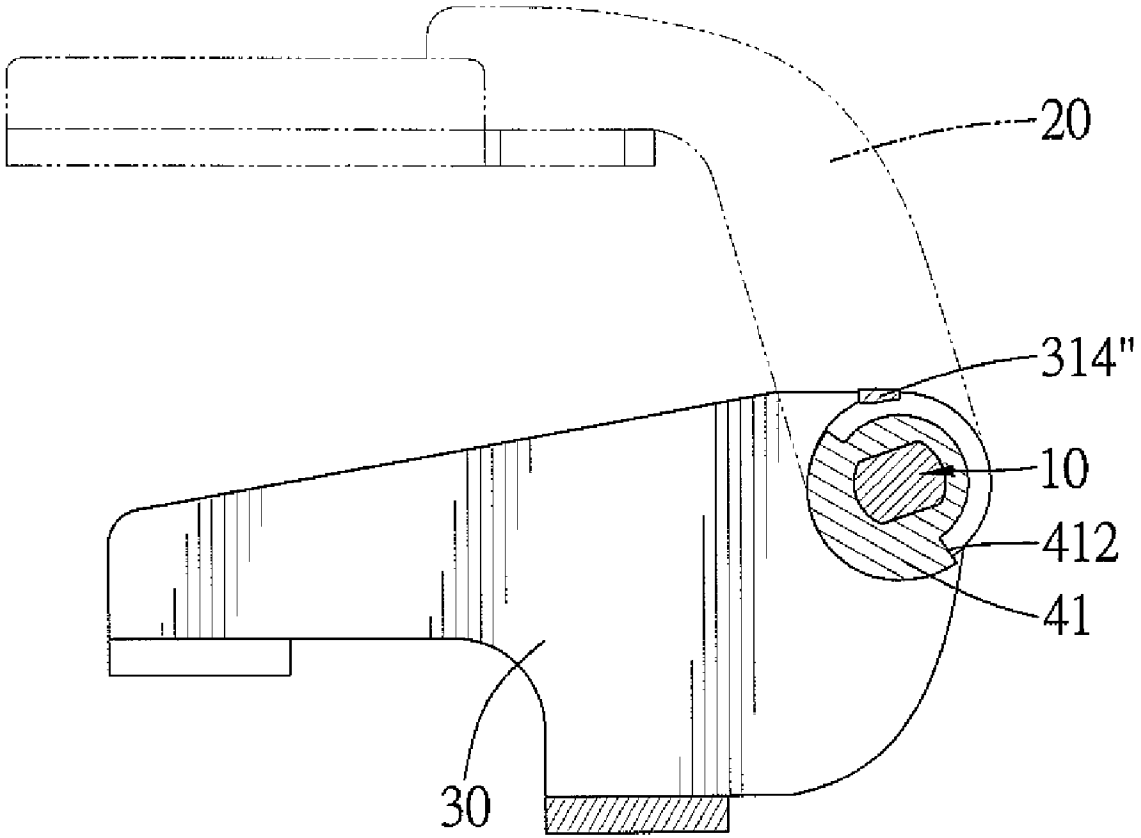
FIGS. 6A and 6B show alternate first and second protrusions of the hinge assembly respectively.
Figure 6B:
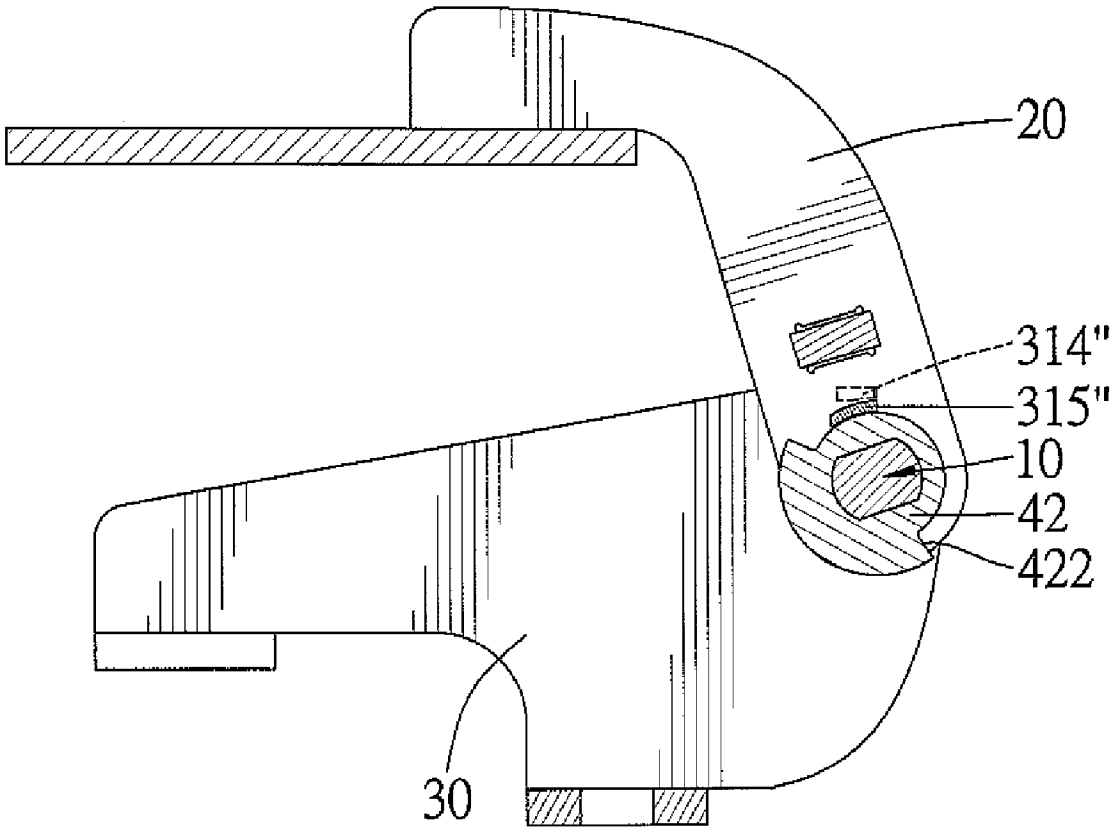

The second coupling member 30 includes a connection end 32 configured to couple to a cover of the notebook computer a pivotal end 31 extended therefrom. The pivotal end 31 defines two opposing faces 311, 312, a pivot hole 313 extending through the opposing faces 311, 312, a first protrusion 314 on the face 311, and a second protrusion 315 on the face 312. The pivot hole 313 is formed with a cross section of circular shape in order to allow pivotal movement of the second coupling member 30 relative to the pintle 10. The first and second protrusions 314, 315 have radial distances with respect to the center of the pivot hole 313 respectively, and the distances are equal. However, the distances may not be equal, as seen in FIGS. 5A and 5B, a first and a second protrusion 314' and 315' have radial distances with respect to the center of the pivot hole 313 respectively, and the radial distances are not equal. FIGS. 6A and 6B show another example of a first and a second protrusion 314", 315" with their radial distances with respect to the center of the pivot hole 313 being unequal.

The first position limiting member 41 has two opposing faces and each face is formed with dents 413 for keeping lubricant and one of the faces is abutted by the face 311. The second position limiting member 42 has two opposing faces and each face is formed with dents 423 for keeping lubricant and one of the faces is abutted by the face 312. Furthermore, the first and second position limiting members 41, 42 have a hole 411, 421 in which the second section 12 of the pintle 10 can be engaged, respectively.

As seen in FIGS. 2, 5-5B, and 6-6B, the first position limiting member 41 has a shape including two arcuate peripheral surfaces and a planar surface as engaging portion 412 interconnecting the two arcuate peripheral surfaces. The engaging portion 412 is used for selectively engaging with the first protrusion 314, 314', 314". The second position limiting member 42 has a shape including two arcuate peripheral surfaces and a planar surface as engaging portion 422 interconnecting the arcuate peripheral surfaces. The engaging portion 422 is used for selectively engaging with the second protrusion 315, 315', 315".

The engagements of the engaging portion 412 with the first protrusion 314, 314', 314" and the engaging portion 422 with the first protrusion 315, 315', 315" happen at the same time.

Referring to FIGS. 2 and 3 again, the positioning means 50 includes a first detent 51 having two opposing faces 513, 514, a hole 511 extending through the opposing faces 513, 514, and a hook 512 engaged in an orifice 316 on the pivotal end 31 of the second coupling member 30. The face 513 has a first ridge, a second ridge, and a third ridge disposed at different radial distances with respect to the center of the hole 511. The face 514 has a plurality of dents 515 for keeping lubricant. The hole 511 has a cross section of circular shape in order to allow a pivotal movement of the first detent 51 relative to the pintle 10. The engagement of the hook 512 with the orifice 316 renders the first detent 51 and the second coupling member 30 pivot simultaneously.

The positioning means 50 further includes a second detent 52 having two opposing faces 523, 524, a hole 521 extending through the opposing faces 523, 524, and four indentations 522 extending in a direction corresponding to that of the hole 521 and communicating with the hole 521. The face 523 has a first recess, a second recess, and a third recess formed complemently receivable with the first, second, third ridges respectively. The face 524 has four stubs 525 formed thereon. The hole 521 has a cross section of a shape that prevents a relative pivotal movement between the second detent 52 and the pintle 10. In this embodiment, the hole 521 includes two arcuate wall portions that complemently abut against the arcuate surfaces of the second section 12 of the pintle 10 and two flat wall portions that abut against the flat surfaces of the second section 12 of the pintle 10, respectively. The indentations 522 are disposed at the corners of the hole 521 respectively so as to prevent stress concentration. The indentations 522 also make the second detent 52 easily moveable, and consequently allow the hinge assembly to withstand greater torque.

The positioning means 50 also includes a resilient member 53 having a hole 531 in which the second section 12 of the pintle 10 can be engaged, and four recessed edges 533 respectively surrounding four stubs 525 on the second detent 52. The hole 531 has a cross section of a shape that precludes a relative pivotal movement between the resilient member 53 and the pintle 10. In this embodiment, the hole 531 includes two arcuate wall portions that complemently abut against the arcuate surfaces of the second section 12 of the pintle 10 and two undulating wall portions (i.e. wavy, toothed, sinusoidal, etc) 532 providing non-continuous contact with the flat surfaces of the second section 12 of the pintle 10, respectively. The non-continuous contact of the resilient member 53 with the pintle 10 renders the resilient member 53 easily biasable, and consequently allows the hinge assembly to withstand greater torque.

As the second coupling member 30 is rotated with respect to the pintle 10, the second detent 52 can be caused to slide along the second section 12 of the pintle 10 and the curvature of the resilient member 53 can be changed, which are resulted from the sliding movement is dependent upon engagement/disengagement of the first, second, third ridges with the first, second, third recesses respectively.

Figure 2:
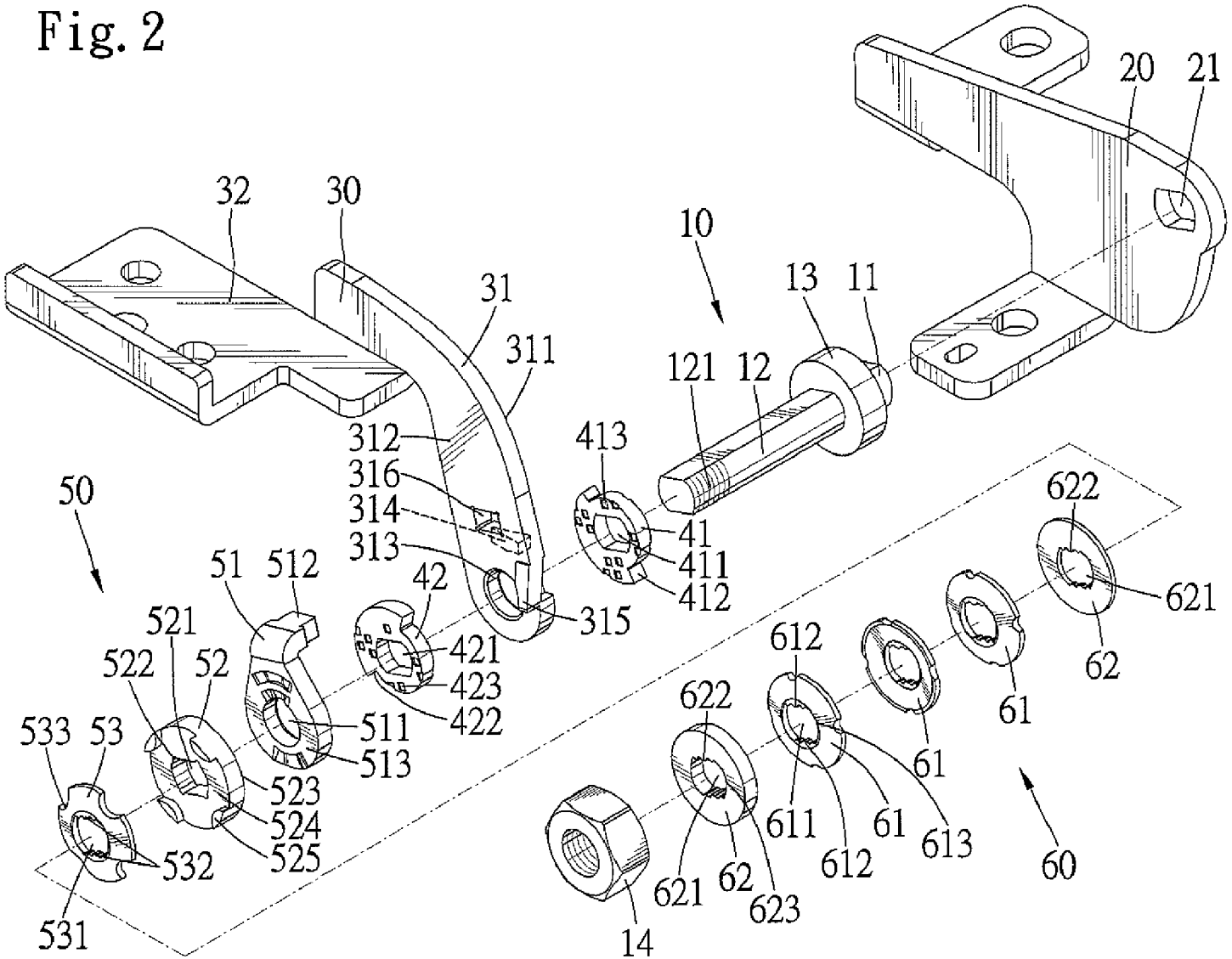
FIG. 2 is an exploded perspective view of the hinge assembly of FIG. 1.
Figure 3:
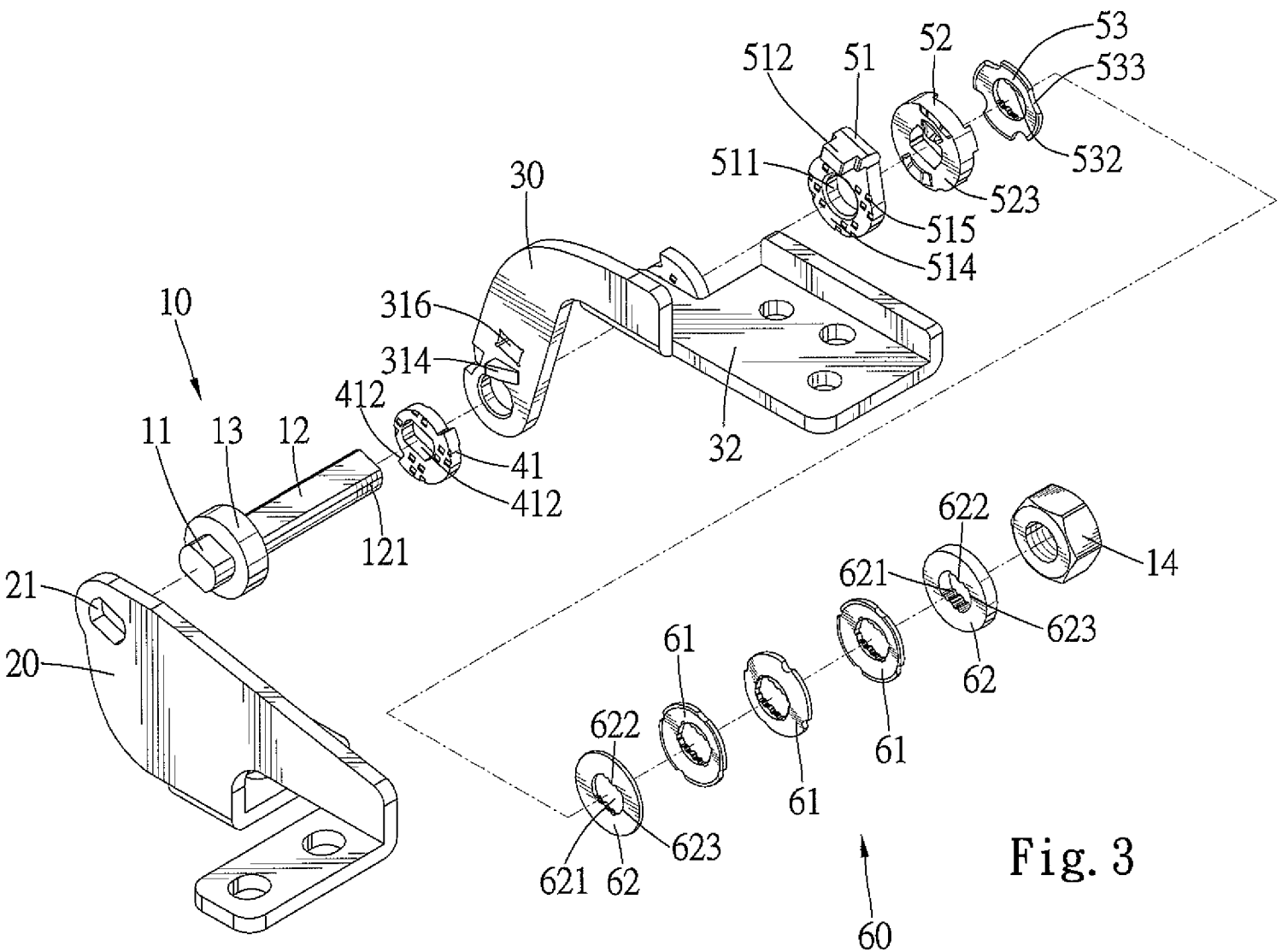
FIG. 3 is an exploded perspective view of the hinge assembly of FIG. 1, taken from a different angle of view.
Figure 4:
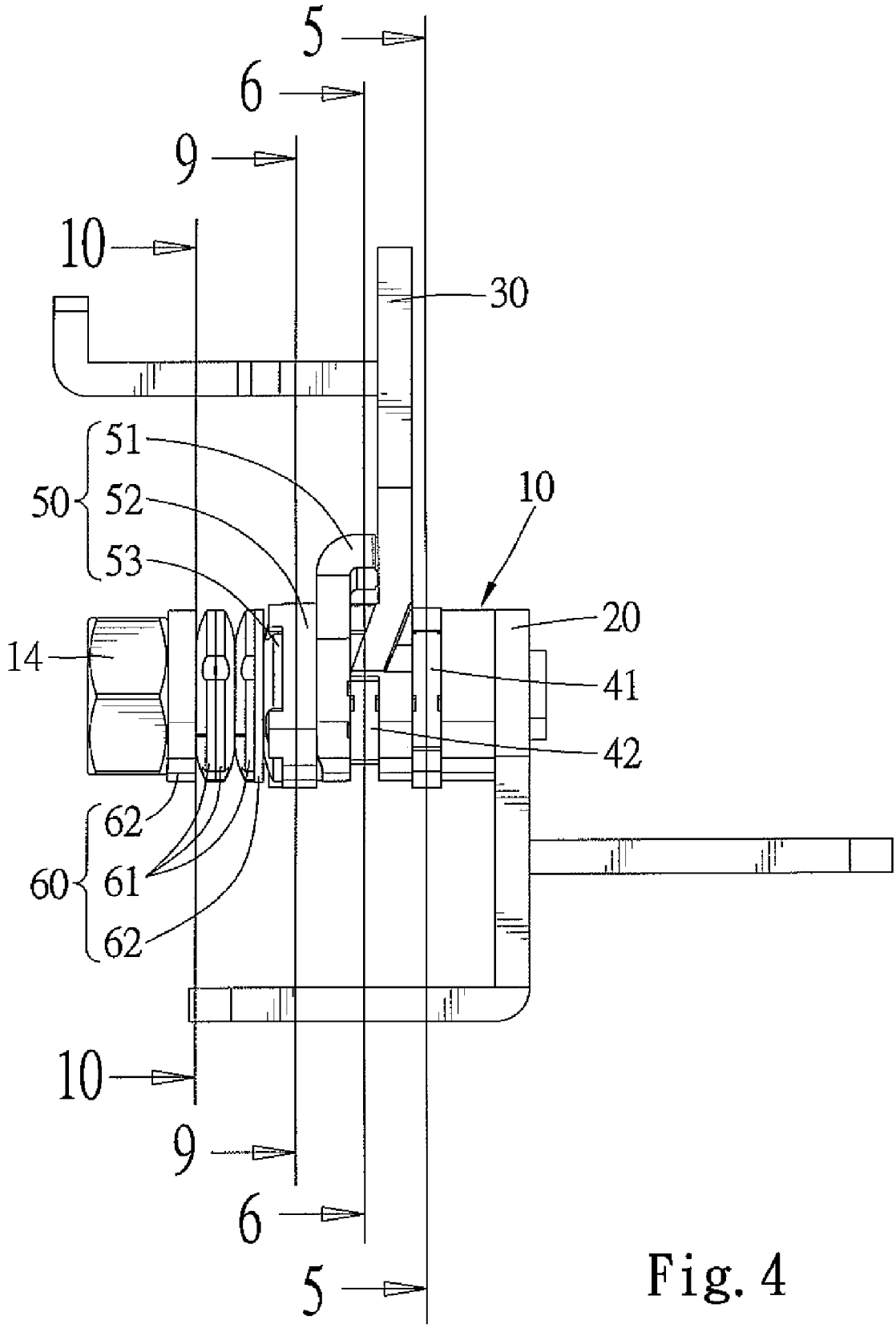
FIG. 4 is a side view of the hinge assembly of FIG. 1.

Still referring to FIGS. 2 and 3, the biasing means 60 includes a plurality of resilient members 61 oppositely disposed with one another and two spacers 62 separated by the resilient members 61. Each resilient members 61 includes a hole 611 in which the second section 12 of the pintle 10 can be engaged. The hole 611 has a cross section of a shape that precludes a relative pivotal movement between the biasing member 60 and the pintle 10. In this embodiment, the hole 611 includes two arcuate wall portions that complemently abut against the arcuate surfaces of the second section 12 of the pintle 10 and two undulating wall portions (i.e. wavy, toothed, sinusoidal, etc) 612 providing non-continuous contact with the flat surfaces of the second section 12 of the pintle 10, respectively. The non-continuous contact of the resilient member 61 with the pintle 10 renders the resilient member 61 easily biasable, and consequently allows the hinge assembly to withstand greater torque.

Each spacer 62 includes a hole 621 in which the second section 12 of the pintle 10 can be engaged. The hole 621 includes two arcuate wall portions 623 that complemently abut against the arcuate surfaces of the second section 12 of the pintle 10 and two undulating wall portions 622 (i.e. wavy, toothed, sinusoidal, etc) providing non-continuous contact with the flat surfaces of the second section 12 of the pintle 10, respectively. Thus, the spacers 62 can possess the same advantageous feature of the resilient members 61.

Figure 7:
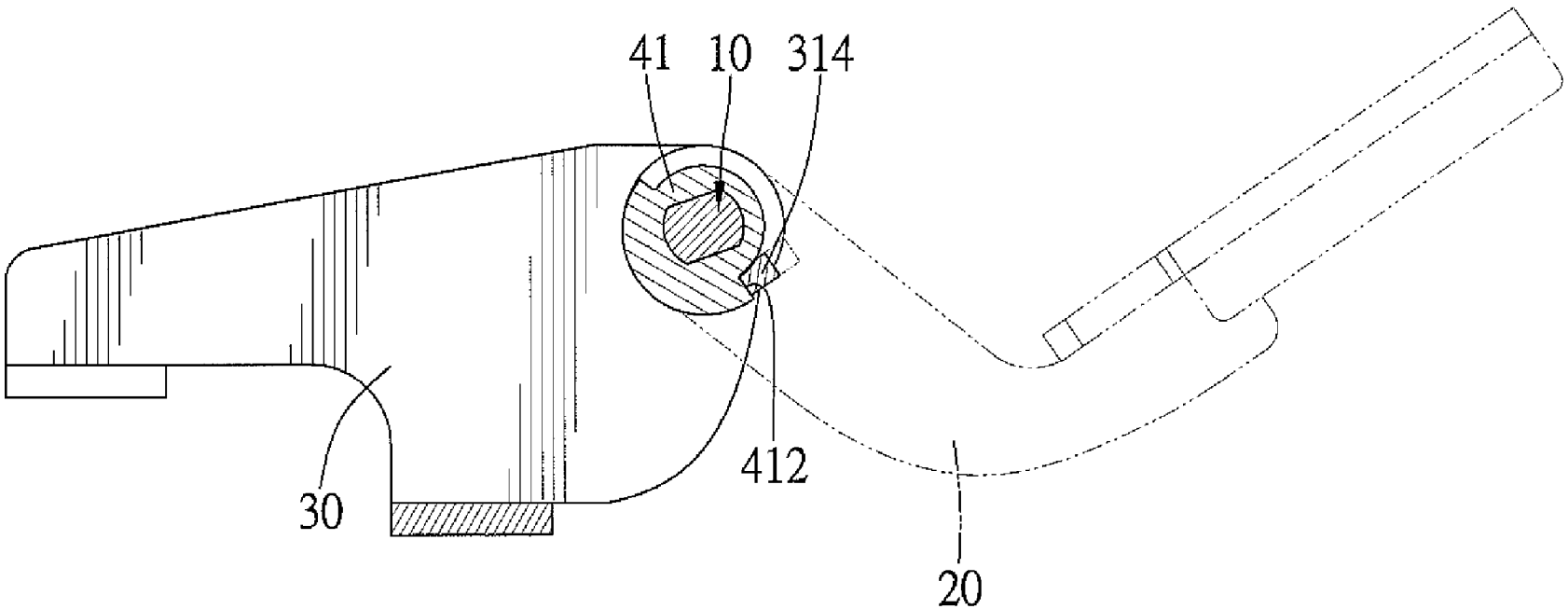
FIG. 7 is similar to FIG. 5 but shows the hinge assembly being operated to another position.
Figure 8:
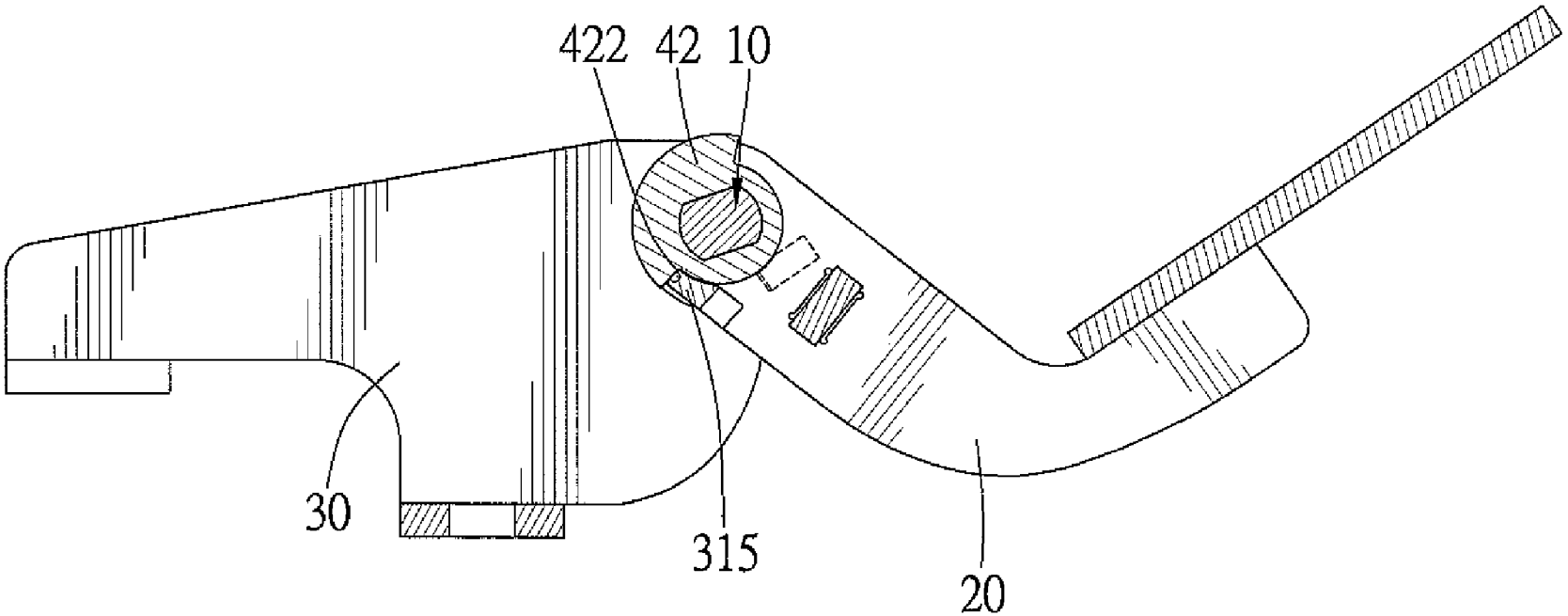
FIG. 8 is similar to FIG. 6 but shows the hinge assembly being operated to another position.
Figure 9:
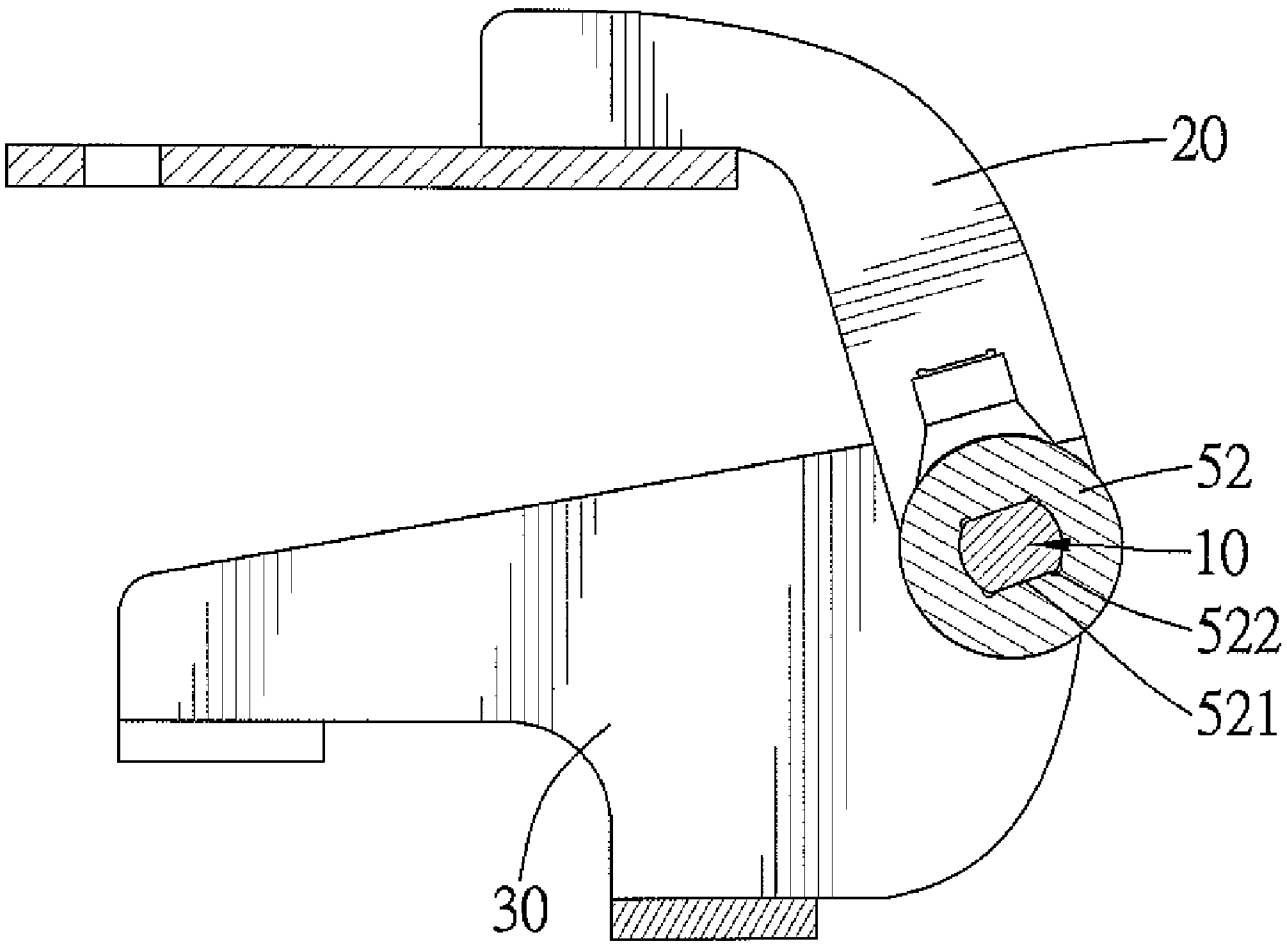
FIG. 9 is a cross-sectional view taken along line 9-9 of FIG. 4.
Figure 10:
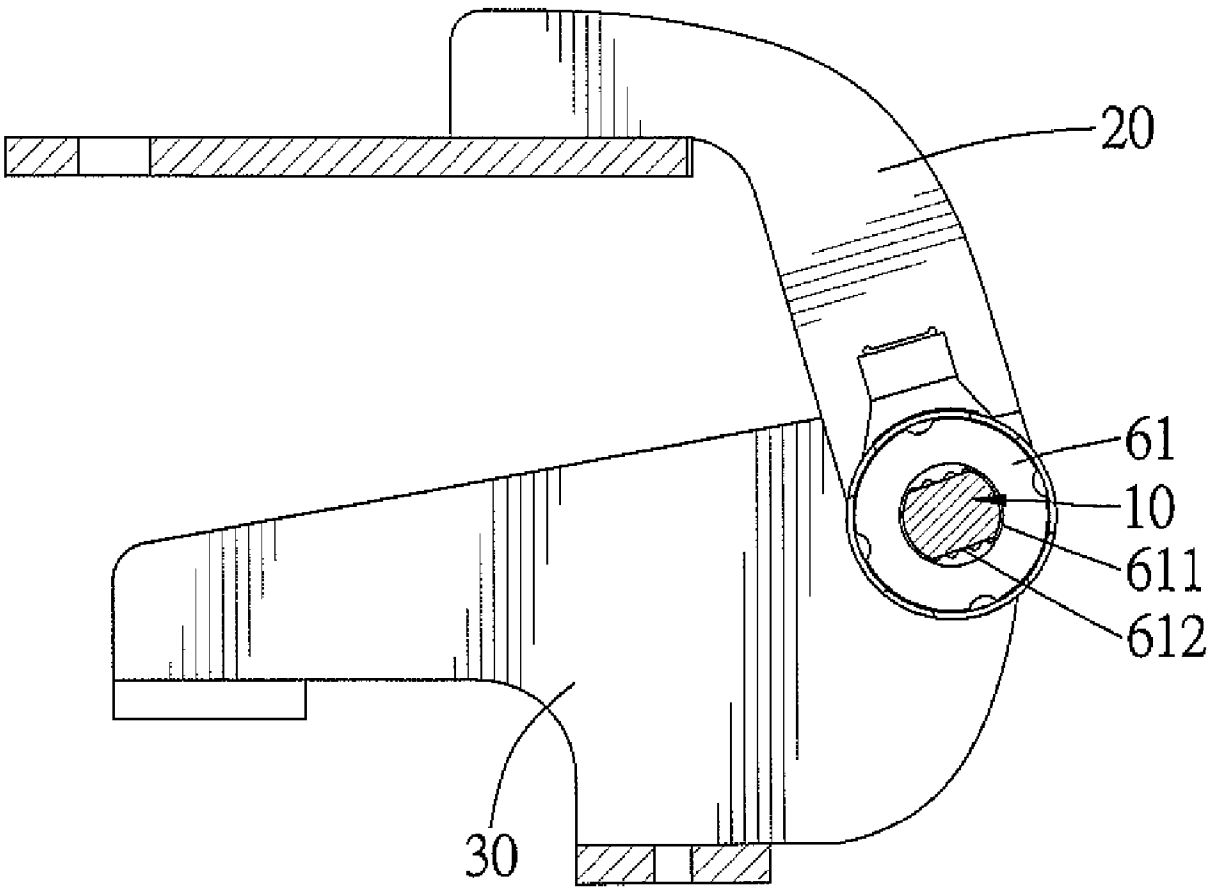
FIG. 10 is a cross-sectional view taken along line 10-10 of FIG. 4.

Referring to FIGS. 5 through 8, FIGS. 5 and 6 show that the hinge assembly is in a closed state, and FIGS. 7 and 8 show that the that the hinge assembly is in a fully open state. When the hinge assembly is fully opened, the protrusion 314 is abutted by the engaging portion 412 and the protrusion 315 is abutted by the engaging portion 422, respectively. These engagements ensure that if the display of the notebook computer bears too much weight, the hinge assembly will sturdily support the display.

Figure 11:
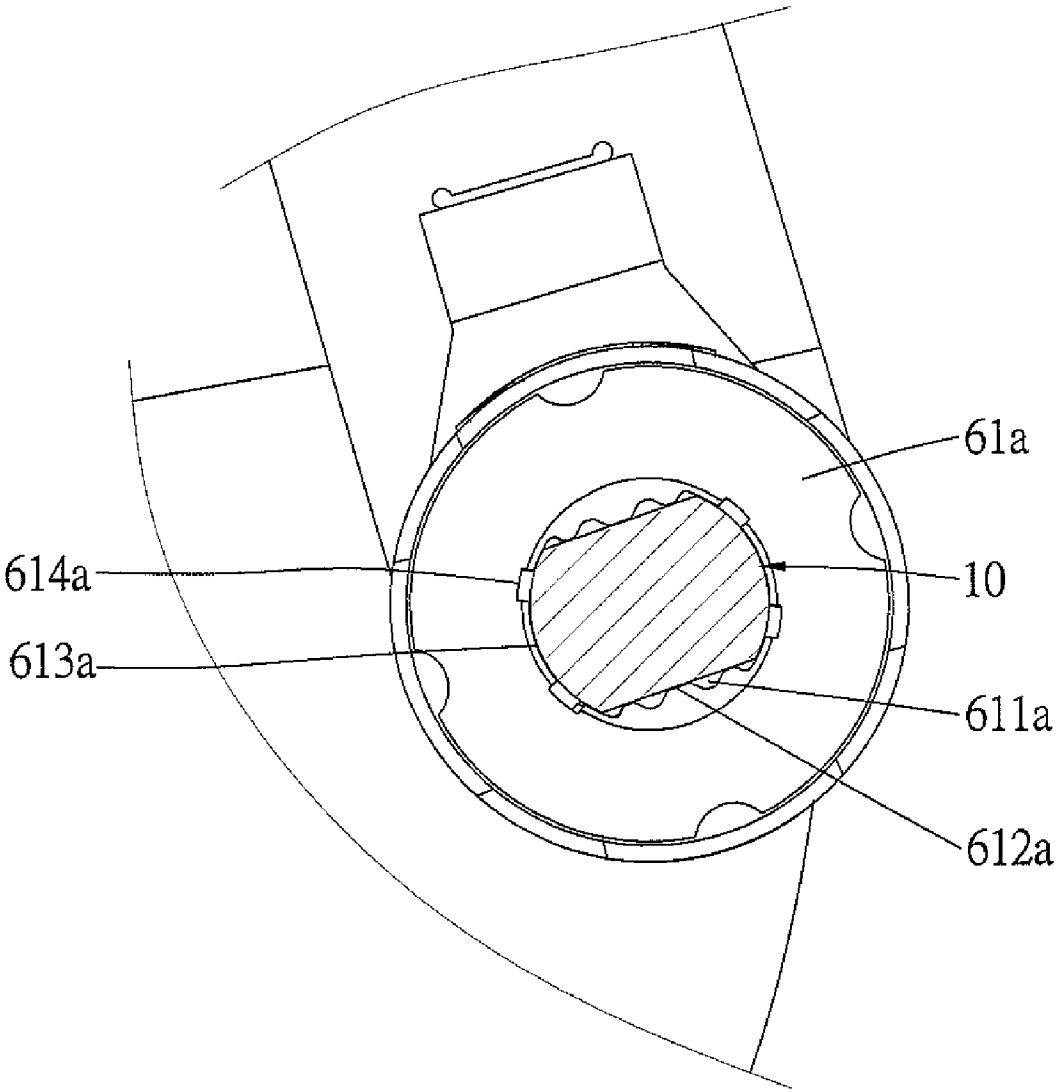
FIG. 11 shows another resilient member of the hinge assembly.

FIG. 11 shows the plurality of resilient members 61 of the biasing device 60 are replaced by the plurality of resilient members 61*a*. Each resilient member 61*a* includes a hole 611*a* having two undulating wall portions 612*a* (i.e. wavy, toothed, sinusoidal, etc) that has non-continuous contact with the flat surfaces of the second section 12 and two arcuate wall portions 613*a* that contacts with the arcuate surfaces of the second section 12. Each arcuate wall portions 613*a* further has two notches 614*a* extending radially outward from the hole 611*a*. The notches 614 are provided for the purpose of allowing the resilient members 61 to be easily biased.

What is claimed is:

1. A hinge assembly comprising:

a pintle including a first section and a second section;

a first coupling member connected to the first section of the pintle;

a second coupling member, including a hole pivotally engaged with the second section of the pintle, a first face, a second face opposite to the first face, a first protrusion formed on the first face, and a second protrusion formed on the second face;

a first and a second position limiting member connected to the second section of the pintle, the first position limiting member including an engaging portion the first protrusion selectively abuts, the second position limiting member including an engaging portion the second protrusion selectively abuts;

a biasing means including a plurality of resilient members connected to the second section of the pintle, each resilient member including a hole having a wall portion contacting non-continuously with the second section of the pintle.

2. The hinge assembly as claimed in claim 1 wherein the wall portion of the hole defines an undulating shape.

3. The hinge assembly as claimed in claim 2 wherein the hole comprises two arcuate wall portions and interconnected by the wall portion.

4. The hinge assembly as claimed in claim 3 wherein each of the arcuate wall portions comprises a notch extending radially outward from the hole.

5. The hinge assembly as claimed in claim 1 wherein the biasing means further comprises a spacer including a hole, and the hole includes two arcuate wall portions, and two undulating wall portions interconnecting the arcuate wall portions.

6. The hinge assembly as claimed in claim 1 wherein the first and the second protrusions have radial distances with respect to the center of the hole being equal respectively.

7. The hinge assembly as claimed in claim 1 wherein the first and the second protrusions have radial distances with respect to the center of the hole being unequal respectively.

8. The hinge assembly as claimed in claim 1 further comprising a positioning means between the second coupling member and the biasing means, with the positioning means including a first detent having a first face on which is formed a ridge, a second detent having a face on which is formed a recess selectively engaging with the ridge, and a resilient member biasably moved upon the engagement/disengagement of the first and second detents.

9. The hinge assembly as claimed in claim 8 wherein the second detent comprises a hole, and four indentations disposed in parallel relation and in communication with the hole.

10. The hinge assembly as claimed in claim 9 wherein the hole of the second detent comprises two arcuate wall portions and two flat wall portions interconnecting the arcuate wall portions, and wherein each of the indentations includes a wall, the walls of the indentations interconnecting the one arcuate wall portion and one flat wall portion respectively.

11. The hinge assembly as claimed in claim 8 wherein the resilient member comprises a hole, with the hole of the resilient member including two arcuate wall portions and two undulating wall portions interconnecting the arcuate wall portions.

* * * * *